US006729220B2

(12) United States Patent
Curtsinger et al.

(10) Patent No.: US 6,729,220 B2
(45) Date of Patent: May 4, 2004

(54) SPRING LOADED DIAMOND ARBOR

(75) Inventors: John Curtsinger, Shelbyville, KY (US); Johnny Hortenbury, Shelbyville, KY (US)

(73) Assignee: Black & Decker Inc., Newark, DE (US)

( * ) Notice: Subject to any disclaimer, the term of this patent is extended or adjusted under 35 U.S.C. 154(b) by 160 days.

(21) Appl. No.: 09/998,508

(22) Filed: Nov. 30, 2001

(65) Prior Publication Data

US 2003/0101859 A1 Jun. 5, 2003

(51) Int. Cl.[7] ..... B26D 1/12

(52) U.S. Cl. ..... 83/666; 83/698.41; 83/954; 125/15; 30/388; 403/247

(58) Field of Search ..... 30/388, 391, 355, 30/347; 83/665, 666, 835, 676, 698.41, 698.42, 698.31, 954; 451/359, 374, 360, 508, 517, 470, 509; 403/325, 328, 259, 366, 359.4, 367, 368, 247, 256; D8/66, 70; D15/133, 138, 139; 125/15

(56) References Cited

U.S. PATENT DOCUMENTS 1,707,903 A 4/1929 Charlton
2,600,459 A * 6/1952 Adams ..... 83/665
2,649,868 A * 8/1953 Gommel ..... 83/665
2,815,077 A * 12/1957 Pechy ..... 83/430
2,822,648 A 2/1958 Metzger et al.
3,894,462 A * 7/1975 Lundtoft ..... 83/665
4,624,876 A * 11/1986 Nevin ..... 428/66.6
4,706,386 A * 11/1987 Wiley ..... 30/388
4,730,952 A 3/1988 Wiley
4,787,147 A 11/1988 Wiley
5,477,845 A * 12/1995 Zuzelo ..... 125/15
5,660,161 A * 8/1997 Chiuminatta et al. ..... 125/15
D392,864 S 3/1998 Koike et al.
6,067,888 A * 5/2000 Achterberg et al. ..... 83/835
6,230,600 B1 * 5/2001 Stroud ..... 83/665
D446,529 S * 8/2001 Park ..... D15/139

* cited by examiner

*Primary Examiner*—Boyer D. Ashley
(74) *Attorney, Agent, or Firm*—Harness, Dickey & Pierce, P.L.C.

(57) ABSTRACT

A spring loaded diamond shaped arbor for use in a saw blade. The arbor includes comprised of a diamond shaped plate having four peripheral side walls with four corners therebetween that separate the four side walls. The arbor has a central opening that is configured and adapted to allow the arbor to be attached to a power tool. A slot extends from the central opening through one of the side walls or corners so that the arbor can easily be inserted into and removed from a saw blade. The slot allows the arbor to be compressed like a spring and be retained within the central opening in the saw blade.

29 Claims, 6 Drawing Sheets

SPRING LOADED DIAMOND ARBOR

FIELD OF THE INVENTION

The present invention relates to saw blades, and, more particularly, to saw blades that use a diamond shaped arbor.

BACKGROUND OF THE INVENTION

A number of different power tools utilize circular saw blades to cut or grind various materials. These power tools have a motor that is selectively operable to rotate a shaft. The selective operation of the motor causes the shaft to rotate. The shafts on these power tools can come in a variety of shapes. For example, the shaft can have a circular cross section, as is typical for most power tools utilizing a circular saw blade, or can have a generally diamond shaped cross section, as is typical in worm gear drive power tools. A circular saw blade for use with these power tools has a central opening that is configured and adapted to fit on the shaft of the power tool and rotate along with the rotation of the shaft so that the power tool can perform a cutting or grinding operation.

Universal saw blades that can be used on power tools having either the circular shaft or the diamond shaped shaft have a generally diamond shaped arbor pressed into the center of the saw blade that can be selectively removed. The arbor has a generally circular central opening that enables the saw blade with the arbor to be used on power tools having a circular shaft. The arbor can be removed from a saw blade thereby leaving a central opening in the saw blade that is diamond shaped. The saw blade with the arbor removed can then be used on power tools having a generally diamond shaped shaft. The use of the diamond shaped arbor thereby enables the saw blade to be used on power tools having either a circular shaft or a diamond shaped shaft.

In making these universal blades, the saw blades begin as blanks in a soft state. A circular central opening is made in the blank along with any teeth, expansions slots, vent slots, etc. The blank is then heat treated to a desired hardness and drawn flat. At this point the universal saw blade is stress free. The saw blade then enters the diamond arbor process wherein a diamond shaped arbor that is centered around the circular central opening is removed from the saw blade. The diamond arbor is removed from a saw blade by laser cutting the arbor from the blade. Alternatively, the diamond arbor is made in a press stamping operation wherein the diamond shaped arbor is punched out of the saw blade. After the diamond arbor is removed from the saw blade, the arbor is then placed back in the saw blade by stamping the arbor into the diamond shaped opening from whence it came. The forcing of the diamond shaped arbor back into the blade creates inner stresses that retain the diamond shaped arbor in the blade but can also affect the quality of any cut made by the blade and can affect the life of the blade. The inner stresses thereby can result in decreasing a user's satisfaction with the universal saw blade. In an attempt to remove the inner stresses, the blade may undergo further manufacturing processes, such as heating the blade up in an attempt to remove the stresses.

After the diamond arbor has been removed from and reinserted into the blade, the blade goes through further manufacturing processes. The processes may include adding specialized tips to the teeth of the saw blade, sharpening the teeth and/or tips, painting the blade, if desired, and grinding and/or polishing the blade. During all these operations, the inner stresses that retain the diamond arbor can cause the arbor to possibly dislodge from the blade thereby increasing the amount of scrap or rework that must be done to manufacture a useable universal saw blade. Additionally, by forcing the diamond arbor into the saw blade by stamping, the arbor may be off centered which would affect the quality of the cuts the blade is capable of making and will cause the blade to be out of round. Finally, the inner stresses may make it difficult for a user of the universal saw blade to remove the arbor so that the blade can be used on a power tool with a diamond shaped shaft.

Therefore, what is needed is a diamond shaped arbor that does not create inner stresses in the universal saw blade. The arbor should be easy to manufacture along with being easy to insert and remove from the universal saw blade. Finally, it would be desirable for the arbor to be self centering.

SUMMARY OF THE INVENTION

The spring loaded diamond shaped arbor of the present invention provides the above desired benefits and features. The arbor can be easily inserted into and removed from the blade. The spring feature of the diamond arbor retains the arbor within the saw blade without introducing inner stresses in the blade. Additionally, because the arbor is spring loaded, the arbor will stay in the saw blade during additional manufacturing processes.

The diamond shaped arbor for use in a saw blade of the present invention comprises a diamond shaped plate having four peripheral side walls with four corners therebetween. The four corners separate the four side walls. There is a central opening that is configured and adapted to allow the arbor to be attached to a power tool. A slot extends from the central opening through one of the side walls or corners so that the arbor can be compressed and easily inserted into and removed from a saw blade. Optionally, but preferably, the slot has opposite slot walls which are generally parallel. However, the opposite slot walls can also diverge as the slot extends from the central opening through one of the side walls or corners. Conversely, the opposite slot walls can converge as the slot extends from the central opening through one of the side walls or corners. Optionally, the slot can curve as the slot extends from the central opening through one of the side walls or corners.

In order to relieve/reduce stress cracking in a saw blade that has a generally diamond shaped central opening that receives the arbor, one or more of the corners in the opening in the saw blade may have rounded recesses, as is known in the art. In this case, the arbor may optionally have one or more complementary projections that extend outward from the corners and occupy the rounded recesses in the saw blade opening. The slot can extend through one of the corners having the projection and in such a case may also extend through the projection.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1A:
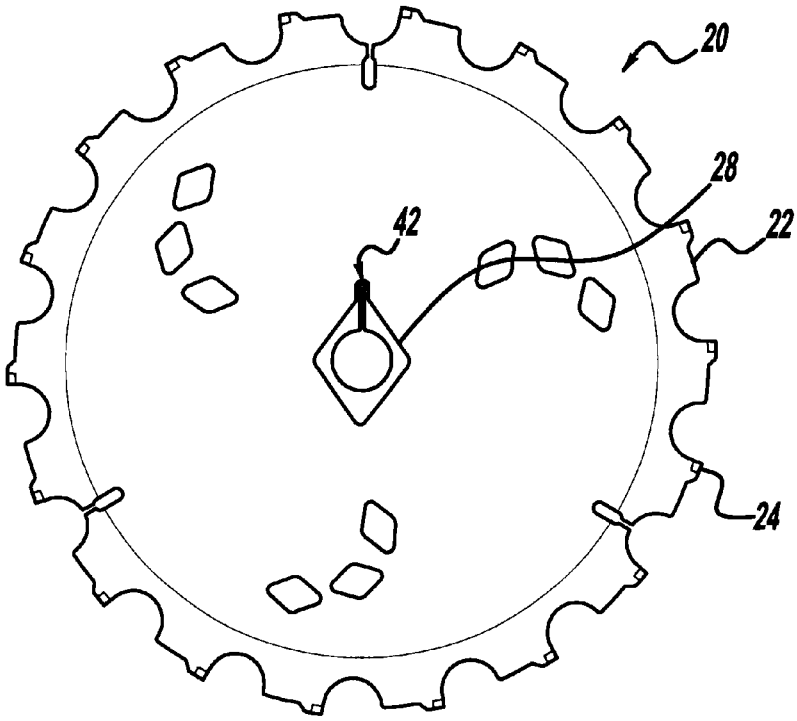
FIG. 1A is a front plan view of a saw blade having a spring loaded diamond shaped arbor according to the principles of the present invention.
Figure 1B:
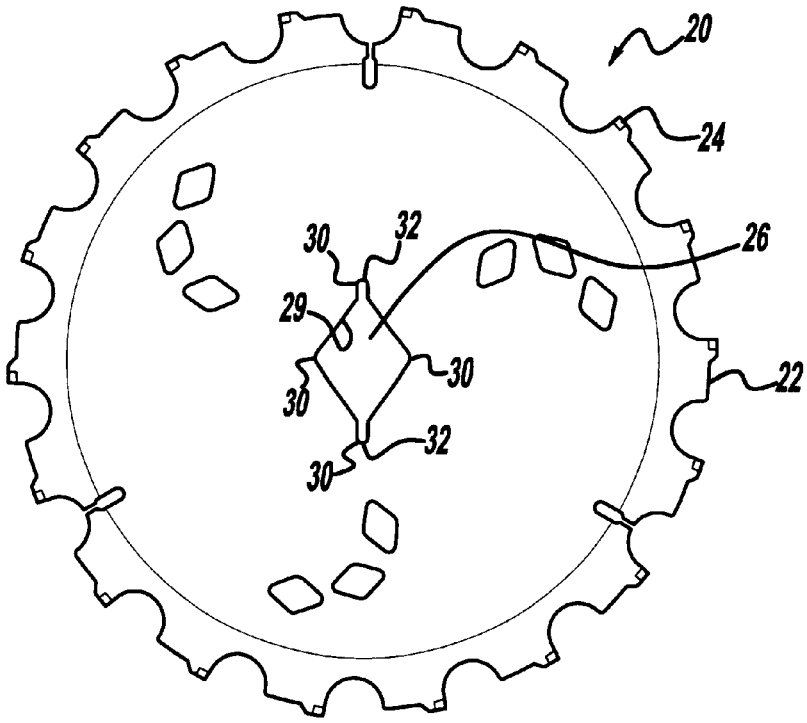
FIG. 1B is a front plan view of the saw blade of FIG. 1A with the diamond shaped arbor removed.

Referring to FIG. 1A, there is shown a saw blade, generally indicated as 20, in accordance with a preferred embodiment of the present invention. The saw blade 20 has a peripheral edge 22 that is generally circular. There are a plurality of teeth 24 that are spaced along the peripheral edge 22. Alternatively, instead of having a plurality of teeth 24, the peripheral edge 22 can be made from an abrasive cutting material which can be used for cutting bricks, tile and other similar types of surfaces, as is known in the art. The saw blade 20, as can be seen in FIG. 1B, has a central opening 26. The central opening 26 is generally diamond shaped and is configured and adapted to allow the saw blade 20 to be used on a power tool that is worm driven and has a generally diamond shaped shaft, as is known in the art. As can be seen in FIG. 1A, the central opening 26 can also receive a generally diamond shaped arbor 28, as will be discussed in more detail below.

The central opening 26 in the saw blade 20 has four side walls 29 and four corners 30 therebetween that separate the four side walls 29. Preferably, the corners 30 in the saw blade 20 are rounded so as to prevent stress cracking in the saw blade 20. Even more preferably, one or more of the corners 30 has a rounded recess 32 that provides greater protection against stress cracking occurring in the corner 30. As can be seen in FIGS. 1A–B, the saw blade 20 has two corners 30 having recesses 32 that are opposite one another.

The saw blade 20 can be made from a variety of materials, as is known in the art. Preferably, the saw blade shown in FIG. 1 is made from a high carbon spring steel. However, it should be understood that the saw blade 20 can be made from a variety of materials, such as when a saw blade 20 is a masonary blade, and still be within the scope of the invention as defined by the claims.

Figure 2A:
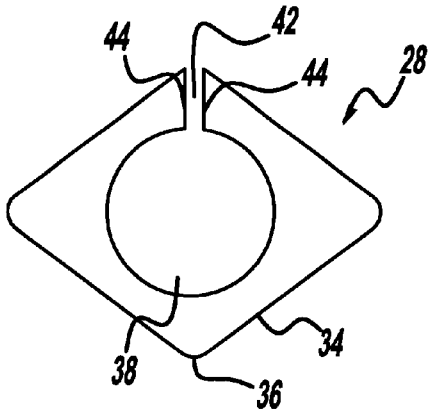
FIGS. 2A–H are front plan views of the spring loaded diamond shaped arbor of the present invention showing various configurations for the slot.
Figure 4:
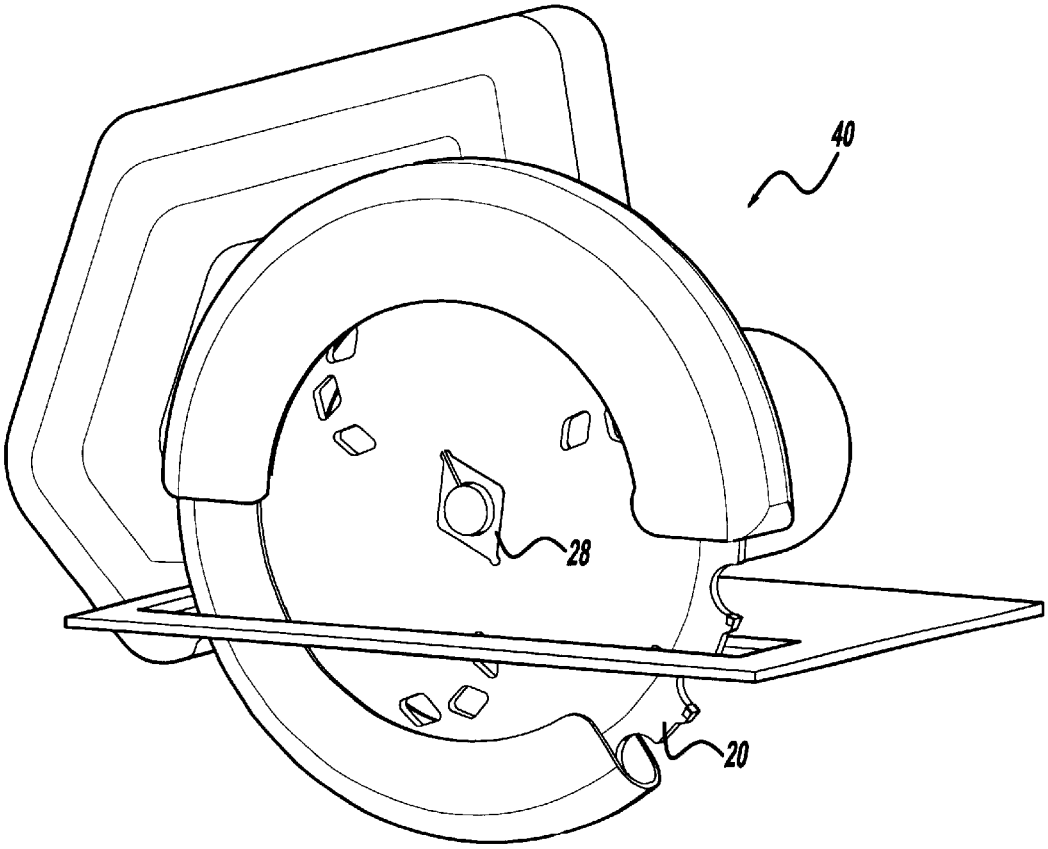
FIG. 4 is a perspective view of a power saw having the saw blade with the spring loaded diamond shaped arbor of FIG. 1A.

Referring now to FIGS. 2A–H, there are shown arbors 28 in accordance with preferred embodiments of the present invention. As can be seen in FIG. 2A, the arbor 28 is generally diamond shaped and has a periphery that is defined by four peripheral side walls 34 and four corners 36 therebetween. The four corners 36 separate adjacent side walls 34. The arbor 28 has a generally circular central opening 38. The circular opening 38 is configured and adapted to allow a saw blade 20 having the arbor 28, as can be seen in FIG. 4, to fit on a power tool, such as a circular saw 40 having a circular shaft (not shown), as is known in the art. The above described features and characteristics of the saw blade 20 and the arbor 28 are conventional and well known in the art.

Figure 2B:
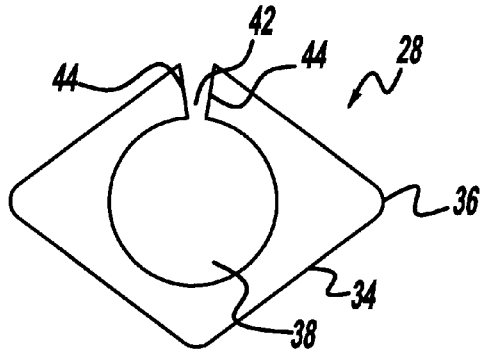
Figure 2C:
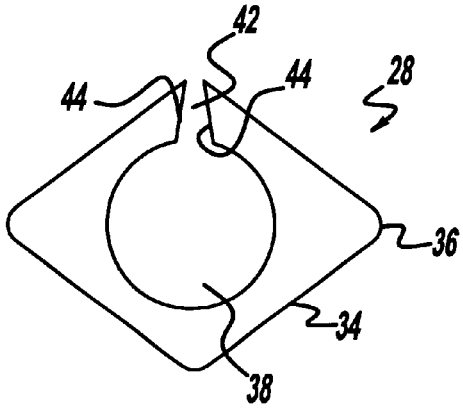
Figure 2D:
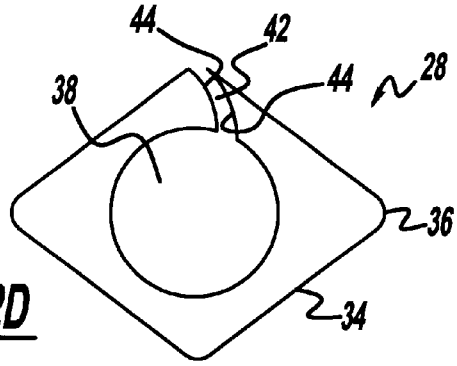
Figure 2E:
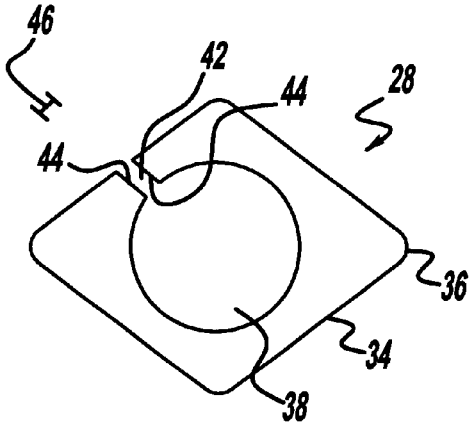

Referring to FIGS. 2A–H, the arbor 28 of the present invention has a slot 42 that extends from the circular opening 28 through one of the side walls 34 or corners 36. The slot 42 has opposite slot walls 44 that define the slot 42 and the width 46 of the slot. As can be seen in FIG. 2A, the slot 42 can extend from the circular opening 38 through one of the corners 36. Alternatively, as can be seen in FIG. 2E, the slot 42 can extend from the circular opening 38 through one of the side walls 34.

Figure 2F:
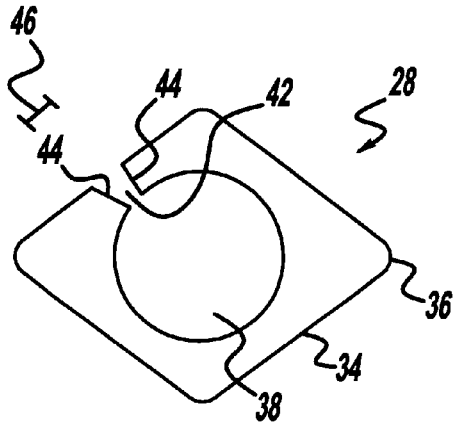
Figure 2G:
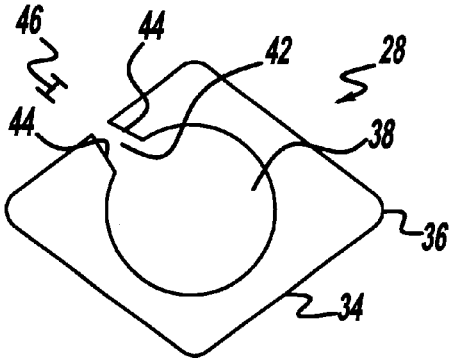
Figure 2H:
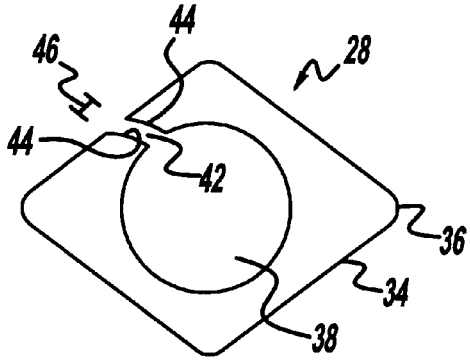

The slot 42 can come in a variety of configurations. For example, as shown in FIGS. 2A and 2E, the slot walls 44 can be generally parallel as the slot 42 extends radially from the circular opening 38 through one of the corners 36 or side walls 34. As can be seen in FIGS. 2B and 2F, the slot walls 44 can diverge as the slot 42 extends from the circular opening 38 through one of the corners 36 or side walls 34. Conversely, as can be seen in FIGS. 2C and 2G, the slot walls 44 can converge as the slot 42 extends from the circular opening 38 through one of the corners 36 or side walls 34. Finally, as can be seen in FIGS. 2D and 2H, the slot 42 can curve as the slot 42 extends from the circular opening 38 through one of the corners 36 or side walls 34. The above described description, configurations and orientations of the slot 42 and the slot walls 44 in relation to the side walls 34 and corners 36 of the arbor 28 are to illustrate the variations in the design of the slot 42 in the arbor 28. These illustrations should not be construed as limiting the scope of the invention to the specific illustrations used, rather the scope of the invention is to be defined by the claims.

The slot 42 enables the arbor 28 to be compressed from its relaxed state (the state where no external forces are acting on the arbor 28). The compression of the arbor 28 facilitates the insertion of the arbor 28 into the central opening 26 in the saw blade 20. After the arbor 28 has been compressed and inserted into the central opening 26 of the saw blade 20, the arbor 28 will attempt to expand to its original or relaxed state. The expansion of the arbor 28 causes the side walls 34 and corners 36 to exert a force on the side walls 29 and/or corners 30 in the central opening 26 of the saw blade 20. The side walls 29 and/or corners 30 of the central opening 26 of the saw blade 20 resist the force being applied by the arbor 28 and effectively maintain the arbor 28 within the central opening 26. The arbor 28 thereby acts like a compressed spring and is retained within the central opening 26 in the saw blade 20. When it is desired to remove the arbor 28 from the central opening 26 in the saw blade 20, the arbor 28 can be easily compressed by a user or a blunt object and then removed from the central opening 26 in the saw blade 20. The spring type action of the arbor 28 thereby retains the arbor 28 within the central opening 26 without causing the inner stresses on the saw blade 20 that occur in the prior art when the arbor 28 is forcibly stamped into the central opening 26 in the saw blade 20. Additionally, because the arbor 28 can be compressed and easily inserted into the central opening 26 in the saw blade 20, when the arbor 28 attempts to return to its original or relaxed state, the arbor 28 will center itself within the central opening 26 in the saw blade 20.

The width 46 of the slot 42 limits the compression of the arbor 28. The dimensions of the various components of the arbor 28, such as the thickness of the arbor 28, the distance between the circular opening 38 and the peripheral side walls 34, etc., and the material out of which the arbor 28 is made determines the force required to compress the arbor 28. Therefore, the width 46 of the slot 42 is dimensioned to account for the amount of compression of the arbor 28 that is desired so that the arbor 28 can be easily inserted into and removed from the central opening 26 in the saw blade 20. That is, when the arbor 28 is easily compressed, the arbor 28 may be slightly larger in size and the width 46 of the slot 42 increased so that when the arbor is compressed and inserted in the central opening 26 in the saw blade 20, the arbor 28 will attempt to return to its original or relaxed state and exert a predetermined force on the side walls 29 and/or corners 30 of the central opening 26 in the saw blade 20 to retain the arbor 28 in the central opening 26. Conversely, when the arbor 28 is not easily compressed, the arbor 28 may be relatively smaller and/or the width 46 of the slot 42 may also be relatively smaller so that when the arbor 28 is inserted into the central opening 26 in the saw blade 20, the arbor 28 exerts a similar retaining force of a predetermined magnitude on the side walls 29 and/or corners 30 of the central opening 26 in the saw blade 20 so that the arbor 28 may be retained within the central opening 26.

Figure 3A:
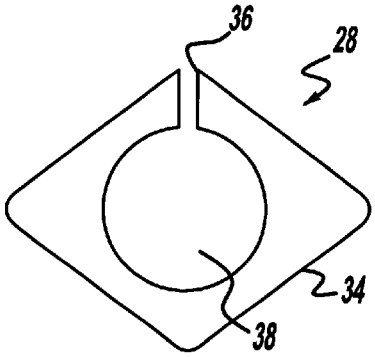
FIGS. 3A–F are front plan views of the diamond shaped arbor of the present invention showing variations on the location of the slot relative to projections on the arbor.
Figure 3B:
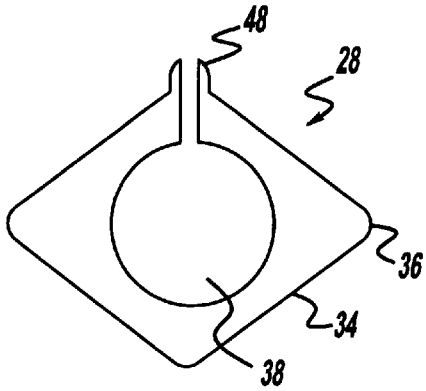
Figure 3C:
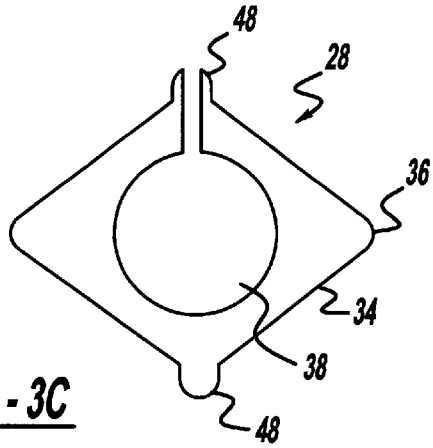
Figure 3D:
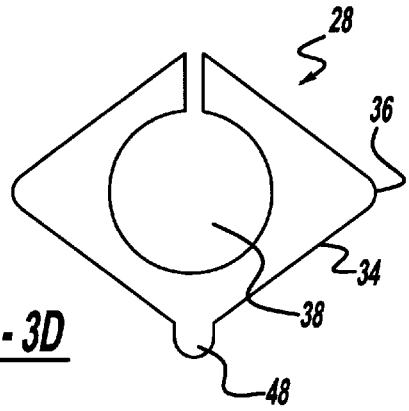
Figure 3E:
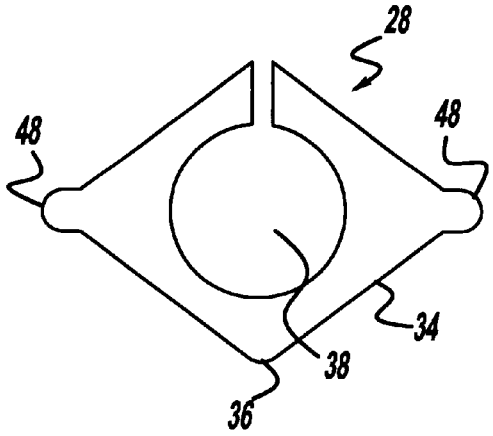
Figure 3F:
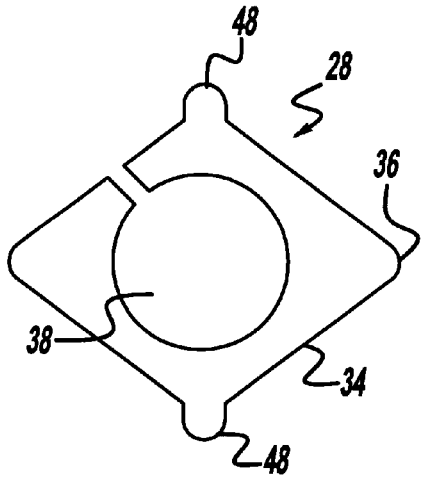

Preferably, as is known in the art, the corners 36 of the arbor 28 are rounded to facilitate the insertion and removal of the arbor 28 in/from the central opening 26 in the saw blade 20. Referring now to FIGS. 3A–F, it can be seen that one or more corners 36 of the arbor 28 can have projections 48 that extend outward from the corners 36. The projections 48 are dimensioned to be complementary to the rounded recesses 32 in the corners 30 in the central opening 26 of the saw blade 20. When one or more corners 36 of the arbor 28 has a projection 48, the slot 42 can extend from the circular opening 38 through one of the corners 36 having a projection 48 (in which case the slot 42 may also extend through the projection 48, as shown in FIGS. 3B–C), or can extend through one of the corners 36 that does not have a projection 48, as shown in FIGS. 3D–E, or can extend through one of the side walls 34, as shown in FIG. 3F. While some of the variations on the orientation of the slot 42 when one or more corners 36 has a projection 48 are shown in FIGS. 3A–F, it should be understood that these figures are merely exemplary and other variations that will be apparent to those skilled in the art are possible. Therefore, the illustrations shown in FIGS. 3A–F should not be viewed as limiting the scope of the invention to the specific examples illustrated. Rather the scope of the invention when one or more corners 36 has a projection 48, should be defined by the scope of the claims. Furthermore, the slot walls 44 are shown in FIGS. 3A–F as being parallel, however, as was discussed above, the slot walls 44 can take on a variety of configurations and still be within the scope of the invention as defined by the claims. Therefore, the slot walls 44 should not be construed as being limited to being only parallel when one or more corners 36 of the arbor 28 has a projection 48.

The arbor 28 can be made in a variety of ways. For example, the arbor 28 can be laser cut or punched from the saw blade 20, as is known in the art and is done in the prior art saw blades, to a desired or predetermined dimensions. The arbor 28 can then be removed from the saw blade 20 and the slot 42 can be created in the arbor 28. The slot can be made by laser cutting, stamping or other known cutting operations. After the slot 42 has been made in the arbor 28, the arbor 28 can then be reinserted into the central opening 26 in the saw blade 20 from whence the arbor 28 was cut or punched. In this situation, the arbor 28 and the saw blade 20 will be made from the same material and will have the same mechanical properties.

Alternatively, the arbor 28 can be provided separately from the saw blade 20 and be made from the same material as the saw blade 20 or made from a different material than the saw blade 20. In this situation, the saw blade 20 will have a central opening 28 that is made in the saw blade 20 by either laser cutting a central opening 26 in the saw blade 20 or punching out a central opening 26 in the saw blade 20, as is known in the art. The arbor 28, which is made from a separate piece of material, can then be inserted into a central opening 26 in the saw blade 20. In this situation, if desired, the arbor 28 can be made from a different material than the saw blade 20. For example, the arbor 28 can be made from plastic and then inserted into a saw blade 20 that is made from high carbon spring steel. However, the arbor 28 can also be made from the same material as the saw blade 20 but still be provided separately and not be made from the material removed from the saw blade 20 to create the central opening 26. Some of the properties that determine what material the arbor 28 is made from include but are not limited to: 1) the resiliency of the material; 2) ability of the material to withstand a compressive force; and 3) thermal conductivity of the material. Numerous materials exhibit sufficient qualities of these properties to enable them to be used for the arbor 28, as will be apparent to those skilled in the art. Therefore, it should be understood that the material out of which the arbor 28 is made should not be limited to the material out of which the saw blade 20 is made or to plastics.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A diamond shaped arbor for use in a saw blade, the arbor comprising:

a diamond shaped plate having four peripheral side walls with four corners therebetween that separate said four side walls, a central opening and a slot extending from said central opening through one of said side walls or corners;

said slot extends through one of said corners;

said slot extends through a first corner of said four corners; and a second corner of said four corners is generally opposite said first corner and has a projection that extends outward from said second corner.

2. A diamond shaped arbor for use in a saw blade, the arbor comprising:

a diamond shaped plate having four peripheral side walls with four corners therebetween that separate said four side walls, a central opening and a slot extending from said central opening through one of said side walls or corners;

said slot extends through one of said corners;

said slot extends through a first corner of said four corners; and a second corner of said four corners that is not opposite said first corner has a projection that extends outward from said third corner.

3. A circular saw comprising:

a motor that is selectively operable to rotate a shaft;

a saw blade mounted to said shaft, said saw blade having a generally circular periphery with a cutting surface thereon and a generally diamond shaped central opening; and a generally diamond shaped arbor that is complementary to said diamond shaped central opening and configured and adapted to be inserted into and removed from said diamond shaped central opening, said arbor having first and second faces and four peripheral side walls with four corners therebetween that separate said four side walls, said four peripheral side walls extending between said first and second faces, a central opening extending through said first and second faces that is configured and adapted to fit on said shaft, and a slot that extends from said arbor central opening through one of said side walls or corners that allow said arbor to be compressed thereby facilitating insertion and removal of said arbor from said diamond shaped central opening.

4. The power saw of claim 3, wherein:

said slot extends through one of said corners.

5. The power saw of claim 3, wherein:

said slot extends through one of said side walls.

6. A diamond shaped arbor for use in a saw blade, the arbor comprising:

a diamond shaped plate having four peripheral side walls with four corners therebetween that separate said four side walls, a central opening and a slot extending from said central opening through one of said side walls or corners;

said slot extends through one of said corners;

a first corner of said four corners has a projection that extends outward from said first corner; and said slot extends through said first corner and through said projection.

7. The arbor of claim 6, wherein:

a second corner of said four corners is generally opposite said first corner and has a projection that extends outward from said second corner.

8. A diamond shaped arbor for use in a saw blade, the arbor comprising:

a diamond shaped plate having first and second faces and four peripheral side walls with four corners therebetween that separate said four side walls, said four peripheral side walls extending between said first and second faces, a central opening extending through said first and second faces and a slot extending from said central opening through one of said side walls or corners.

9. The arbor of claim 8, wherein:

said slot has opposite slot walls which are generally parallel.

10. The arbor of claim 8, wherein:

said slot has opposite slot walls which diverge as said slot extends outwardly from said central opening.

11. The arbor of claim 8, wherein:

said slot has opposite slot walls which converge as said slot extends outwardly from said central opening.

12. The arbor of claim 8, wherein:

said slot extends through one of said corners.

13. The arbor of claim 8, wherein:

said slot extends through one of said side walls.

14. The arbor of claim 8, wherein:

said arbor is made from spring steel.

15. The arbor of claim 8, wherein:

said arbor is made from plastic.

16. The arbor of claim 8, wherein:

said slot curves as said slot extends outwardly from said central opening.

17. A saw blade for use on a power saw, the saw blade comprising:

a generally circular plate having a periphery with a cutting surface thereon and a generally diamond shaped central opening;

a generally diamond shaped arbor that is complementary to said diamond shaped central opening and configured and adapted to be inserted into and removed from said diamond shaped central opening; and said arbor having first and second faces and four peripheral side walls with four corners therebetween that separate said four side walls, said four peripheral side walls extending between said first and second faces, a generally circular central opening extending through said first and second faces, and a slot that extends from said circular central opening through one of said side walls or corners that allows said arbor to be compressed thereby facilitating insertion and removal of said arbor from said diamond shaped central opening.

18. The saw blade of claim 17, wherein:

said slot has opposite slot walls which are generally parallel.

19. The saw blade of claim 17, wherein:

said slot has opposite slot walls which diverge as said slot extends outwardly from said circular central opening.

20. The saw blade of claim 17, wherein:

said slot has opposite slot walls which converge as said slot extends outwardly from said circular central opening.

21. The saw blade of claim 17, wherein:

said slot extends through one of said side walls.

22. The saw blade of claim 17, wherein:

said plate and said arbor are made from the same material.

23. The saw blade of claim 17, wherein:

said arbor is made from plastic.

24. The saw blade of claim 17, wherein:

said slot curves as said slot extends outwardly from said circular central opening.

25. The saw blade of claim 17, wherein:

said slot extends through one of said corners.

26. The saw blade of claim 25, wherein:

said slot extends through a first corner of said four corners; and a second corner of said four corners is generally opposite said first corner and has a projection that extends outward from said second corner.

27. The saw blade of claim 25, wherein:

said slot extends through a first corner of said four corners; and a second corner of said four corners that is not opposite said first corner has a projection that extends outward from said third corner.

28. The saw blade of claim 25, wherein:

a first corner of said four corners has a projection that extends outward from said first corner; and said slot extends through said first corner and through said projection.

29. The saw blade of claim 28, wherein:

a second corner of said four corners is generally opposite said first corner and has a projection that extends outward from said second corner.

* * * * *